United States Patent [19]

Güentert et al.

[11] Patent Number: 4,989,571

[45] Date of Patent: Feb. 5, 1991

[54] FUEL INJECTION PUMP FOR INTERNAL COMBUSTION ENGINES

[75] Inventors: Josef Güentert, Gerlingen; Johann Warga, Bietigheim-Bissingen, both of Fed. Rep. of Germany

[73] Assignee: Robert Bosch GmbH, Stuttgart, Fed. Rep. of Germany

[21] Appl. No.: 448,427

[22] Filed: Dec. 11, 1989

[30] Foreign Application Priority Data

Dec. 31, 1988 [DE] Fed. Rep. of Germany ..... 3844430

[51] Int. Cl.[5] ..... F02M 59/26

[52] U.S. Cl. ..... 123/495; 123/509; 123/462

[58] Field of Search ..... 123/495, 451, 509, 468, 123/469, 364, 462; 417/499, 494

[56] References Cited

U.S. PATENT DOCUMENTS

| | | | |
|---|---|---|---|
| 3,898,970 | 8/1975 | Malpass | 123/462 |
| 4,389,987 | 6/1983 | Frankle | 123/462 |
| 4,481,930 | 11/1984 | Chadwick | 123/495 |
| 4,494,513 | 1/1985 | Torizuka | 123/495 |
| 4,530,335 | 7/1985 | Torizuka | 123/495 |
| 4,543,045 | 9/1985 | Ritter et al. | 417/499 |
| 4,640,255 | 11/1985 | Häfele et al. | 123/495 |
| 4,770,149 | 9/1988 | Krämer et al. | 123/495 |
| 4,811,716 | 3/1989 | Guntert | 123/495 |
| 4,842,497 | 6/1989 | Hafele | 123/495 |

FOREIGN PATENT DOCUMENTS 861762 1/1953 Fed. Rep. of Germany .

*Primary Examiner*—Carl Stuart Miller

*Attorney, Agent, or Firm*—Edwin E. Greigg

[57] ABSTRACT

A fuel injection pump for internal combustion engines having housing with a plurality of in-line pump elements including pump cylinders, surrounded by separate suction chambers and communicating with them by means of overflow openings, having two primary conduits disposed parallel to a camshaft for the inflow and outflow of fuel to and from the separate suction chambers and having defined connecting conduits between each separate suction chamber and each primary conduit by means of which the same quantity of fuel is metered to all the separate suction chambers under the influence of a pressure drop produced by the connecting conduits wherein an inflow connecting conduits has one fuel inflow throttle insert for the fuel inflow primary conduits the throttle insert being closed at one end and discharges with its open end into the separate suction chamber with its closed end protruding into the fuel inflow primary conduit the throttle insert having a defined throttle opening for conducting fuel from the primary conduit into the separate suction chamber.

25 Claims, 2 Drawing Sheets

FUEL INJECTION PUMP FOR INTERNAL COMBUSTION ENGINES

BACKGROUND OF THE INVENTION

The invention is based on a fuel injection pump for internal combustion engines. Such fuel injection pumps are embodied either as so-called in-line injection pumps, in which there is a separate pump element for each cylinder of the engine and these pump elements are disposed in a line, or as so-called reciprocating slide pumps, which are primarily intended for heavy-duty use, for instance in trucks.

In the second type of fuel injection pumps, not only exact metering of the injection quantity but a very accurate setting of the instant of injection onset are attained by axially displacing a control slide provided on each pump piston, and/or by rotating the pump piston.

In both types of injection pumps, an overflow of the highpressure fuel at the metering control edges causes heating of this returning fuel, which also heats the fresh fuel located in the suction chamber. The heating changes the physical properties such as density and compressibility of the fuel, so that the quantity of fuel metered per pump stroke and its energy content both vary as well. In the ensuing injection, temperature differences in the fuel supplied therefore leads to changes in the output of the engine cylinders.

Near the entrance of the fuel inlet conduit, the fuel temperature in the suction chamber is still relatively low, because of the high proportion of fresh fuel, but with increasing distance from the entry, this temperature rises until it has attained a maximum in the region of the fuel outflow from the suction chamber. The fuel temperatures in the various pump work chambers of the injection pump are correspondingly variable, with the abovediscussed consequences.

To avoid nonuniform cylinder outputs, such fuel injection pumps have separate suction chambers, from which the injection pump is supplied with fuel. By means of equal volumetric flows of fuel in all the separate suction chambers, the fuel temperature can be kept the same in all the separate suction chambers.

In a known fuel injection pump of the generic type involved of a reciprocating slide pump (German Offenlegungsschrift 35 46 222), the volumetric fuel flows in the separate suction chambers are regulated by providing radial branch bores, acting as throttles, in the wall of a tube that acts as a fuel inlet conduit and tapers in steps in the direction of the flow; there is one bore in each step, and via an associated connecting conduit, it communicates with an associated separate suction chamber. The cross sections of these radial branch bores and their length are adapted to one another such that the volumetric flow through the bores is the same for the all the pump elements. The rotational position of the tube is defined by a fixation screw running in the housing; this position must meet very high demands for accuracy, so that particularly with reciprocating slide pumps, it must first be assured that the connecting conduit between the throttle opening in the tube and separate suction chamber and the throttle opening itself are precisely in alignment, because otherwise the volumetric flow is reduced, and second that there be sufficient sealing between the tube and the pump housing to prevent leakage, which would also affect the volumetric flow. For the same reason, the tube must be fitted very accurately into the pump housing. Especially in pumps having a high number of cylinders, this means high production expense and hence high production costs.

Production expenses and costs are also increased because of the fact that metering tubes for in-line pumps must be embodied differently from those for reciprocating slide pumps, so that in mass production, two different metering tubes must be produced.

Besides an accurate positioning of the tube in the pump housing and fastening the tube, there are other problems. Since the position of the tube must meet high demands for accuracy, the fastening must be correspondingly reliably embodied to prevent shifting and twisting. Because the fuel flow is deflected sharply as it enters the suction chamber, there is a danger of cavitation damage to the surrounding material.

In known injection systems of this generic type, the connecting conduit between the metering tube and an electric shutoff means must be disposed at a particular site. This has a disadvantage of determining the positioning of the electric shutoff means on the pump housing, so that it cannot be freely selected.

OBJECT AND SUMMARY OF THE INVENTION

The fuel injection pump according to the invention, has an advantage over the prior art that the demands for accuracy in terms of shape and location of the supply bore, and hence the production costs, are much lower. By using throttle inserts, closed on one end and having a throttle bore, which are standardized DIN components, for metering the fuel into the separate suction chambers, and then introducing them into the housing bores provided between the primary conduit and the separate suction chambers, the production costs are reduced markedly, because first, these components can be used for both in-line and reciprocating slide pumps (large-scale mass production), and second, much greater dimensional tolerances are allowable for the primary conduit and the housing bores between the primary conduit and the separate suction chambers than in the case of fuel injection pumps using a metering tube. The condition of the throttle bores in terms of dimensional accuracy, manufacturing rate, and so forth, can also be easily checked or monitored.

Another advantage is that the positioning of the connecting conduit between the electric shutoff means and the supply bore can be selected largely freely.

In an advantageous feature of the invention, the throttle insert is fitted with its open end into a connecting conduit leading from the primary conduit to the separate suction chamber. In this embodiment, the throttle insert performs two functions, namely not only metering of the injection quantity but also sealing off the connecting conduit between the separate suction chamber and the primary conduit from leakage.

In another advantageous feature of the invention, the throttle insert is manufactured oversize, that is, with a diameter that is somewhat in excess of the diameter of the associated connecting conduit. By forcing the throttle insert into the connecting conduit, the desired position is attained. This has an advantage that good sealing against leakage is obtained, no fastening elements need to be provided for the throttle insert.

In still another advantageous further feature, the throttle insert is additionally secured against loosening by means of circular caulking. This has an advantage that the position of the throttle insert is permanently secured by simple means.

In a further advantageous feature of the invention, the throttle insert is forced flush into a housing bore provided in the pump housing in order to produce the conduit connecting the associated primary conduit with the separate suction chamber. This has the advantage that the throttle insert simultaneously serves to seal off the primary conduit from the outside. A separate sealing element, such as a screw or a forced-in ball, is unnecessary, but may be used in addition.

An advantageous embodiment is obtained once again by manufacturing the throttle insert oversize, in this region associated with this housing bore as well. As a result, not only is good sealing assured, but the position of the throttle insert is additionally secured.

In a further advantageous feature of the invention, the throttle opening is punched into the throttle insert. This is a particularly simple and cost-effective production method, which is suitable for mass production given the high number of parts produced.

In a further advantageous feature of the invention, the throttle insert has the shape of a cylinder. This is a particularly simple shape to manufacture and therefore is costeffective.

In another advantageous feature of the invention, the throttle insert has a shape that tapers conically toward the open end. This embodiment has the advantage that the oversize throttle insert can be forced particularly well into the connecting conduit between the primary conduit and the separate suction chamber.

In still another advantageous feature of the invention, which is favorable particularly with throttle inserts that are also forced into the second housing bore, the throttle insert comprises a cylindrical region and a conically tapering region. The conical region is associated with the conduit connecting the primary conduit and the separate suction chamber, and the cylindrical region is associated with the housing bore leading to the outside. This has the advantage that the oversize throttle insert can be forced in particularly well, and the diameter can at least sometimes be kept smaller, compared with the purely conical throttle insert.

In yet another advantageous feature of the invention, the connecting conduit between the primary conduit and the separate suction chamber discharges into the separate suction chamber at a tangent. This has the advantage that fewer gas bubbles causing cavitation damage are produced at the fuel entry, since the fuel is not forced to make as many changes in direction, and the major pressure drop characteristic of a central entry do not occur.

Although German Patent 861 762 does disclose reducing the danger of cavitation by means of a tangential entry of the fuel into the pump work chamber, it relates to an injection pump of a very different design. Furthermore, in the present invention, although the fuel does enter at a tangent, it is not the pump work chamber that is entered but rather the separate suction chamber, which is not present in the aforementioned patent. Additionally, the manner in which the threatening gas bubbles are removed is different, because in the prior patent, the tangentially supplied fuel is forced along a substantially circular path during the intake stroke; as a result, the lightweight gas bubbles collect in the middle, and because of their lower specific gravity rise upward through a bore in the pump piston to reach an overflow opening and the return conduit. In the present invention, the separate suction chamber experiences a permanent flow of fuel, and any gas bubbles that occur despite the tangential entry of the fuel are entrained by the fuel stream into the return conduit.

In a further advantageous feature of the invention, the fuel outlet opening is provided centrally and is offset in height relative to the inlet opening. This has the advantage that any gas bubbles produced at the fuel entry are rapidly removed, since the tangential entry and central exit of the fuel creates a swirl that entrains the bubbles and carries them rapidly away through the central exit opening.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
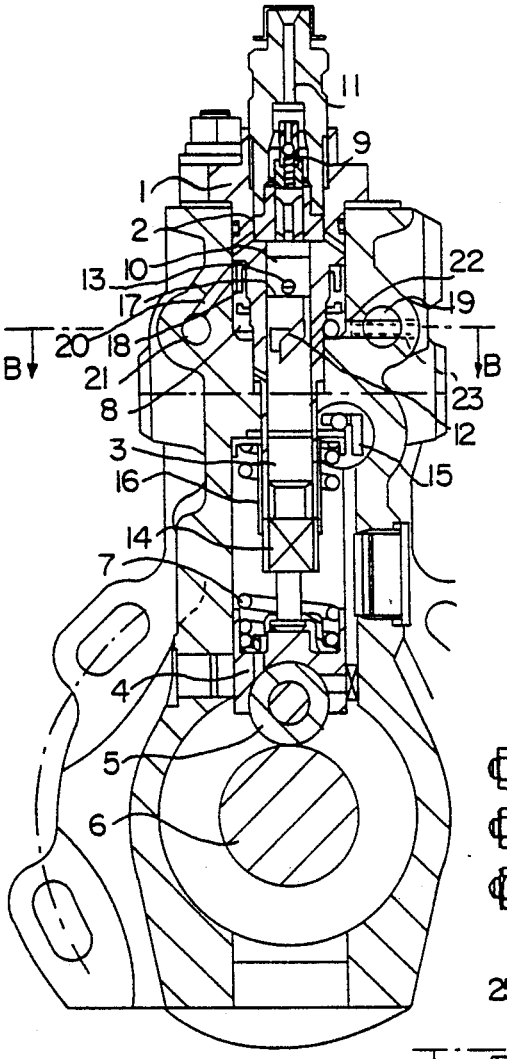
FIG. 1 is a longitudinal section along the line A—A of FIG. 2 through an in-line injection pump according to the invention.

In the fuel injection pump shown, six cylinder liners 2 are inserted in line in a housing 1; in each of them one pump piston 3 is driven, via an interposed roller tappet 4 and roller 5, by a camshaft 6 counter to pump supply pressure and counter to the force of a spring 7, to produce its axial motion embodying the working stroke. Corresponding recesses in the cylinder liners 2 and in the housing 1 form separate suction chambers 8, each one associated with one pump element embodied by a cylinder liner 2 and a pump piston 3.

The pump piston 3, cylinder liner 2 and a pressure valve 9 define a pump work chamber 10, from which a pressure conduit 11 leads to a pressure line, not shown, that ends at an injection nozzle on the engine. Each pump piston 3 has an oblique groove with a control edge 12, which cooperates with an overflow opening 13 of the cylinder liner 2 for fuel metering; the overflow opening 13 leads into the separate suction chamber 8 and simultaneously acts as an intake opening.

The pump piston 3 has flattened portions 14 on its lower portion, which are engaged by a bushing 16 rotatable in a known manner by means of a governor rod 15, so that an axial displacement of the governor rod 15 causes a rotation of the pump piston 3 and hence a change in the association of the control edge 12 relative to the overflow opening 13. The pump piston 3 has a second control edge 17, which defines the onset of fuel supply by covering the overflow opening 13 as the piston 3 is raised. To prevent the diverted outflow fuel, which is at high pressure and is flowing back into the separate suction chamber 8, from causing any erosion on the surface of the cylinder liner 2 because of its kinetic energy, an impact ring 18 is provided.

The fuel supply to the various separate suction chambers 8 is effected in common for all six separate suction chambers 8 by means of one inflow conduit 19. The fuel not attaining injection leaves the separate suction chambers 8, each via a respective connecting conduit 20, and enters a return conduit 21. Connecting conduits 22 are provided between each separate suction chamber 8 and the inflow conduit 19, and housing bores 23 are provided, each in the axial extension of the conduits 22, between the inflow conduit 19 and the outside. Throttle inserts 24, which are closed at one end of a blind bore 29 are shown in further detail in FIG. 3. The throttle inserts are forced flush into each of the associated opening pairs, each pair comprising a connecting conduit 22 which connects with the suction chamber 8 and a housing bore 23; the open end of the throttle insert discharges into the separate suction chamber 8. The middle region of each of the throttle inserts 24, located in the inflow conduit 19, is provided with a throttle bore 25 through which fuel flows from inflow conduit 19 via blind bore 29 to the connecting conduit 22 of the suction chamber 8.

Figure 2:
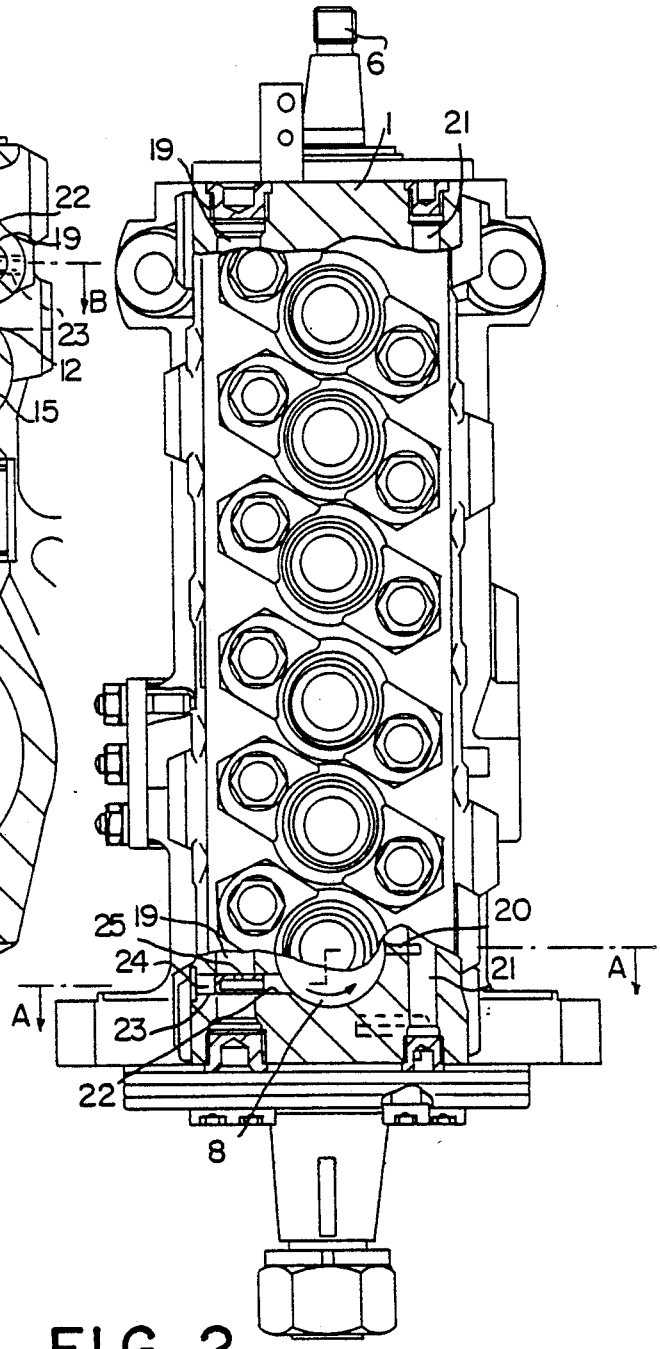
FIG. 2 is a fragmentary cross section along the line B—B of FIG. 1 through this pump, with some components left out to more clearly illustrate the invention.

The direction of fuel flow into the separate suction chambers 8 is represented in FIG. 2 by the arrow 36.

Figure 3:
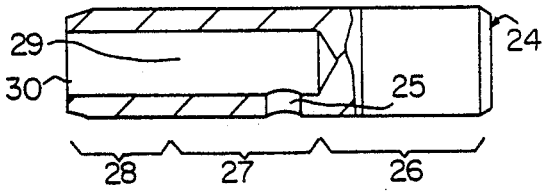
FIG. 3 is a longitudinal section through a metering stopper according to the invention.

The throttle insert 24 shown in FIG. 3 is closed at one end and has three different regions 26, 27 and 28. The region 26 located on the closed end is embodied in solid form, and serves as a seal between the inflow conduit 19 and the exterior of the fuel injection pump.

The middle region 27 and the region 28 located on the open end of the throttle insert 24 has an axial blind bore 29, which connects the throttle bore 25, extending radially to the outside in the middle region 27, with the opening 30 of the throttle insert 24.

The region 26 toward the closed end and the region 27 in the middle are preferably embodied with cylindrical outer dimensions, while the region 28 toward the open end is preferably embodied with an outer dimension that tapers conically toward the opening 30.

The fuel injection pump shown in FIGS. 1 and 2 functions as follows:

During at least a portion of the intake stroke of the pump piston 3 and in the vicinity of bottom dead center of its stroke, fuel flows out each of the respective suction chambers 8 through the overflow opening 13 into the pump work chamber 10. In the ensuing compression stroke of the pump piston 3, the pressure required for the injection does not build up in the pump work chamber 10 until the overflow opening 13 has been completely covered by the pump piston 3. Until then, fuel continues to flow out of the pump work chamber 10 back into the separate suction chamber 8.

After the closure of the overflow opening 13, the high pressure required for the injection builds up in the pump work chamber 10, and the delivery to the engine and injection begin via the pressure valve 9 and pressure conduit 11. Once the highpressure stroke of the pump piston 3 has been executed, the pump work chamber 10 is made to communicate with the separate suction chamber 8 via the overflow opening 13, so that the fuel that continues to be pumped is diverted at high pressure into the separate suction chamber 8. This effective injection stroke of the pump piston 3 is determined by the rotational position of the pump piston 3, which variously corresponds to a predetermined distance between the control edge 12 and the radial bore 13, so that a variously long stroke of the pump piston 3 must be executed before the pump work chamber 10, as a result of this uncovering, is made to communicate via the overflow opening 13 with the separate suction chamber 8 to terminate the injection.

From the inflow conduit 19, fresh fuel continuously flows through the throttle bore 25 and the blind bore 29 in the throttle insert 24, and via the connecting conduit 22, into the separate suction chambers 8. From there, the excess fuel flows out via the connecting conduit 20 into the return conduit 21, and via further connecting conduits, not shown, is returned to the fuel reservoir.

The throttle bores 25 of the various throttle inserts 24 are designed such that for all six pump elements, the same pressure drop between the inflow conduit 19 and the separate suction chamber 8 exists, and fuel of the same volumetric flow is delivered to each of the separate suction chambers 8. As a result, a uniform filling of the pump work chamber with fuel for each separate fuel pump piston at the same temperature, is assured, even in extreme operating states.

Additionally, the tangential entry of the fuel into the separate suction chambers 8 not only reduces the formation of gas bubbles but also, in combination with the central exit that is offset in height, imparts a swirl to the fuel that despite any gas bubbles that may be produced promotes their removal.

In in-line injection pumps, to generate a constant volumetric flow of fuel in the separate suction chambers 8, the throttle inserts 24 may be introduced into the connecting conduits 20 between the separate suction chamber 8 and the return conduit 21 on the outflow side instead of on the inflow side. The design of the return conduit 21 and the dimensional relationships between the connecting conduits 20 and the throttle inserts 24 should be selected in accordance with the above-discussed version. Once again, by being, forced into the corresponding housing bores, the throttle inserts 24 can simultaneously serve as a sealing means between the separate suction chamber 8 and the return conduit 21, or between the return conduit 21 and the outside.

Figure 4:
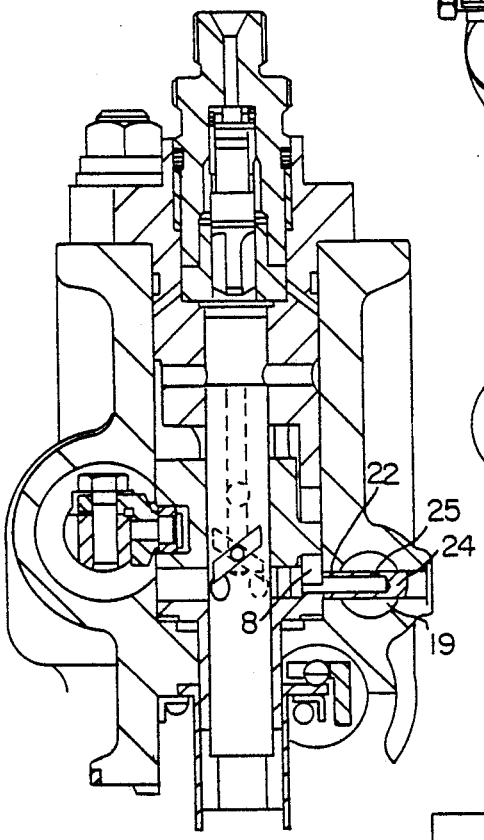
FIG. 4 is a longitudinal section along the line C—C of FIG. 5 through a reciprocating slide pump according to the invention.
Figure 5:
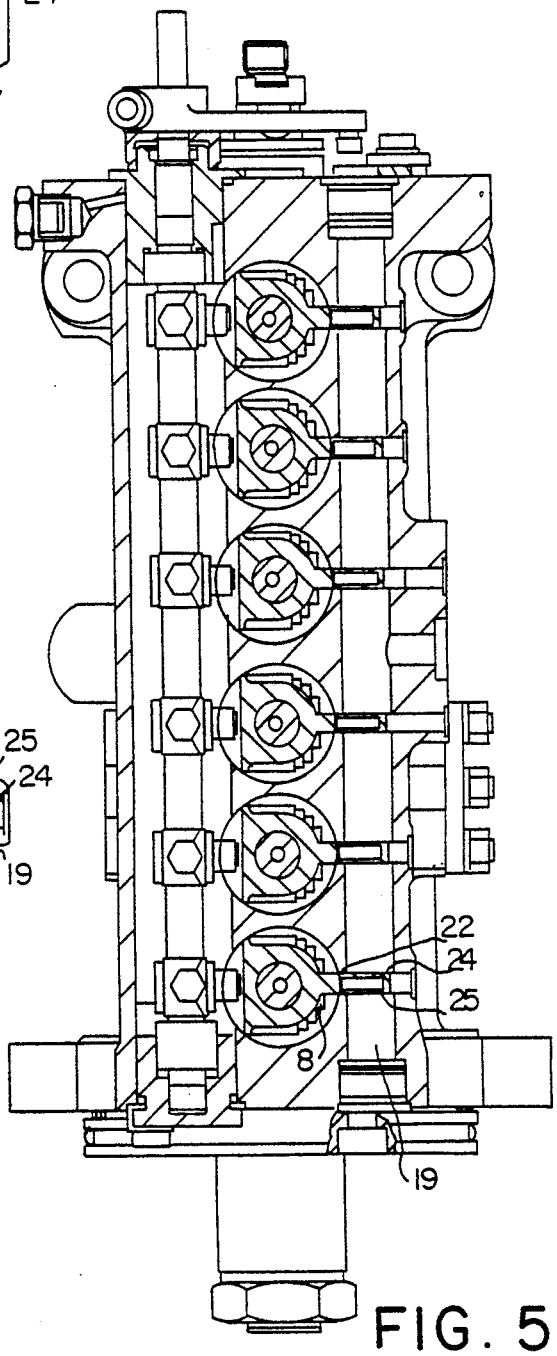
FIG. 5 is a cross section along the line D—D of FIG. 4 through this pump, with some components left out to more clearly illustrate the invention.

In FIGS. 4 and 5, the use of the throttle inserts 24 according to the invention in a reciprocating slide pump is shown. Unlike the in-line pump, in this case because of the design of reciprocating slide pumps, the throttle inserts 24 can be accommodated only in the connecting conduits 22 between the primary conduit 19 and the separate suction chamber 8. By exchanging the connections for the inflow and outflow, however, once again it becomes possible to provide the throttle inserts on the outflow side:

The mode of operation of the throttle inserts 24 having the throttle bore 25 to generate a constant volumetric fuel flow in each of the separate suction chambers 8 is identical here. The mode of operation of a reciprocating slide pump itself is described for instance in German Offenlegungsschrift 35 46 222. An essential difference in the use of the throttle inserts 24 according to the invention in reciprocating slide pumps is that a tangential fuel entry is irrelevant in reciprocating slide pumps.

The foregoing relates to a preferred exemplary embodiment of the invention, it being understood that other variants and embodiments thereof are possible within the spirit and scope of the invention, the latter being defined by the appended claims.

What is claimed and desired to be secured by letters patent of the United States is:

1. A fuel injection pump for internal combustion engines having a pump housing, a plurality of pump elements disposed in line in said pump housing, each of said pump elements have pump cylinders disposed in receiving bores of the pump housing and pump pistons operating in the pump cylinders by an associated cam shaft, separate suction chambers surrounding each of said pump cylinders and an overflow opening communicating with each of said suction chambers, a control edge disposed on each of said pump pistons that cooperates with the overflow openings for metering of the injection quantity, fuel inflow and fuel outflow primary conduits disposed parallel to the camshaft for the inflow and outflow of fuel to and from the separate suction chambers, and a pair of connecting conduits, one connecting conduit present between each separate suction chamber and said inflow primary conduit and between each separate suction chamber and said outflow primary conduit, by means of said connecting conduits a same quantity of fuel can be metered to each of said separate suction chambers, under an influence of a pressure drop produced by said connecting conduits, a throttle insert in said connecting conduit leading from said fuel inflow primary conduit to each said separate suction chamber, said throttle insert (24), closed at one end and open at one end and discharging with its open end into one of the said separate suction chambers (8) and the closed end protruding into the fuel inflow primary conduit (19), the throttle insert having a defined throttle opening (25) opening into said fuel inflow primary conduit 2. A fuel injection pump as defined by claim 1, in which said throttle opening (25) is disposed radially to a longitudinal axis of the throttle insert (24).

3. A fuel injection pump as defined by claim 1, in which said throttle insert (24) is forced flush with its open end (30) into the connecting conduit (22) between the said fuel inflow primary conduit (19) and said separate suction chamber (8).

4. A fuel injection pump as defined by claim 2, in which said throttle insert (24) is forced flush with its open end (30) into the connecting conduit (22) between the said fuel inflow primary conduit (19) and said separate suction chamber (8).

5. A fuel injection pump as defined by claim 1, in which said throttle insert (24) is manufactured oversize and is forced into the connecting conduit (22).

6. A fuel injection pump as defined by claim 1, in which said throttle insert (24) is secured against loosening by means of circular caulking.

7. A fuel injection pump as defined by claim 1, in which said throttle insert (24) is forced into a housing bore (23) provided in the pump housing (1) with said closed end thereof flush with said housing in order to produce the conduit (22) connecting the associated primary conduit (19) with the separate suction chamber (8).

8. A fuel injection pump as defined by claim 7, in which said throttle insert (24) is manufactured oversize in the closed end region (26) associated with said housing bore (23) and is forced into said housing bore (23).

9. A fuel injection pump as defined by claim 1, in which said throttle opening (25) is punched into the throttle insert (24).

10. A fuel injection pump as defined by claim 1, in which said throttle insert (24) has the shape of a cylinder.

11. A fuel injection pump as defined by claim 1, in which said throttle insert (24) tapers conically toward its open end (30).

12. A fuel injection pump as defined by claim 1, in which said throttle insert (24) has a cylindrical region and a conically tapering region, wherein the conical region is associated with the conduit (22) connecting the associated primary conduit (19) with the separate suction chamber, while the cylindrical region is associated with the housing bore (23) leading outward from the primary conduit (19) and with the fuel inflow primary conduit (19) itself.

13. A fuel injection pump as defined by claim 1, in which said connecting conduit (22) between the inflow fuel primary conduit (19) and said separate suction chamber (8) discharges at a tangent into said separate suction chamber (8).

14. A fuel injection pump as defined by claim 2, in which said connecting conduit (22) between the inflow fuel primary conduit (19) and said separate suction chamber (8) discharges at a tangent into said separate suction chamber (8).

15. A fuel injection pump as defined by claim 3, in which said connecting conduit (22) between the inflow fuel primary conduit (19) and said separate suction chamber (8) discharges at a tangent into said separate suction chamber (8).

16. A fuel injection pump as defined by claim 4, in which said connecting conduit (22) between the inflow fuel primary conduit (19) and, said separate suction chamber (8) discharges at a tangent into said separate suction chamber (8).

17. A fuel injection pump as defined by claim 5, in which said connecting conduit (22) between the inflow fuel primary conduit (19) and said separate suction chamber (8) discharges at a tangent into said separate suction chamber (8).

18. A fuel injection pump as defined by claim 6, in which said connecting conduit (22) between the inflow fuel primary conduit (19) and said separate suction chamber (8) discharges at a tangent into said separate suction chamber (8).

19. A fuel injection pump as defined by claim 7, in which said connecting conduit (22) between the inflow fuel primary conduit (19) and said separate suction chamber (8) discharges at a tangent into said separate suction chamber (8).

20. A fuel injection pump as defined by claim 8, in which said connecting conduit (22) between the inflow fuel primary conduit (19) and said separate suction chamber (8) discharges at a tangent into said separate suction chamber (8).

21. A fuel injection pump as defined by claim 9, in which said connecting conduit (22) between the inflow fuel primary conduit (19) and said separate suction chamber (8) discharges at a tangent into said separate suction chamber (8).

22. A fuel injection pump as defined by claim 10, in which said connecting conduit (22) between the inflow fuel primary conduit (19) and said separate suction chamber (8) discharges at a tangent into said separate suction chamber (8).

23. A fuel injection pump as defined by claim 11, in which said connecting conduit (22) between the inflow fuel primary conduit (19) and said separate suction chamber (8) discharges at a tangent into said separate suction chamber (8).

24. A fuel injection pump as defined by claim 12, in which said connecting conduit (22) between the inflow fuel primary conduit (19) and said separate suction chamber (8) discharges at a tangent into said separate suction chamber (8).

25. A fuel injection pump as defined by claim 13, in which said connecting conduit between said separate suction chamber (8) and said fuel outflow conduit connects with said separate suction chamber (8) centrally, and in a manner offset in height relative to the connecting conduit between said fuel inflow primary conduit (19) and said separate suction chamber (8).

* * * * *